US008757848B2

(12) United States Patent
Na et al.

(10) Patent No.: US 8,757,848 B2
(45) Date of Patent: Jun. 24, 2014

(54) DOUBLE REFLECTING STRUCTURE

(75) Inventors: Jin Ho Na, Suwon-si (KR); Seong Je Kang, Gyeongsan-si (KR)

(73) Assignees: Kia Motors Corporation, Seoul (KR); SL Corporation, Daegu (KR)

( * ) Notice: Subject to any disclaimer, the term of this patent is extended or adjusted under 35 U.S.C. 154(b) by 205 days.

(21) Appl. No.: 13/316,323

(22) Filed: Dec. 9, 2011

(65) Prior Publication Data

US 2013/0083543 A1 Apr. 4, 2013

(30) Foreign Application Priority Data

Sep. 29, 2011 (KR) ..... 10-2011-0099105

(51) Int. Cl.
*F21V 7/00* (2006.01)
*F21V 7/06* (2006.01)
*F21V 13/04* (2006.01)

(52) U.S. Cl.
USPC ..... 362/327; 362/297; 362/346; 362/507; 362/517; 362/518

(58) Field of Classification Search
USPC ..... 362/297, 327, 346, 507, 517, 518
See application file for complete search history.

(56) References Cited

U.S. PATENT DOCUMENTS

| | | | | | |
|---|---|---|---|---|---|
| 4,037,096 | A | * | 7/1977 | Brendgord et al. | 362/294 |
| 4,310,876 | A | * | 1/1982 | Small et al. | 362/298 |
| 4,899,261 | A | * | 2/1990 | Blusseau et al. | 362/521 |
| 6,053,623 | A | * | 4/2000 | Jones et al. | 362/310 |
| 6,471,383 | B1 | * | 10/2002 | Oyama et al. | 362/517 |
| 2003/0035299 | A1 | | 2/2003 | Amano | |

FOREIGN PATENT DOCUMENTS

| | | | |
|---|---|---|---|
| JP | 2003-59313 | A | 2/2003 |
| KR | 100644700 | B1 | 11/2006 |
| KR | 1020080055126 | A | 6/2008 |
| KR | 20-2009-0008696 | U | 8/2009 |
| KR | 1020100119513 | A | 11/2010 |
| WO | WO 2008/007492 | A1 | 1/2008 |

* cited by examiner

*Primary Examiner* — Stephen F Husar
*Assistant Examiner* — James Cranson, Jr.
(74) *Attorney, Agent, or Firm* — Morgan, Lewis & Bockius LLP

(57) ABSTRACT

A double reflecting structure may include a first reflecting portion reflecting light that may be emitted from a light source, and a second reflecting portion formed on one side of the first reflecting portion to reflect again the light that may be reflected by the first reflecting portion.

6 Claims, 3 Drawing Sheets

DOUBLE REFLECTING STRUCTURE

CROSS-REFERENCE TO RELATED APPLICATION

The present application claims priority to Korean Patent Application No. 10-2011-0099105, filed on Sep. 29, 2011 in the Korean Intellectual Property Office, the entire contents of which is incorporated herein for all purposes by this reference.

BACKGROUND OF THE INVENTION

1. Field of the Invention

The present invention relates to a double reflecting structure, and more particularly, to a double reflecting structure which can emit a predetermined quantity of light even with a small number of light sources.

2. Description of Related Art

In general, lamps are to emit light through power supply thereto, and head lamps installed in a vehicle emit light in a forward direction of the vehicle to secure a driver's visual field, and rear lamps emit light in a rearward direction of the vehicle so that a rear driver can confirm the movement of the traveling vehicle.

In the nighttime driving of a vehicle on which lamps are mounted, a driver drives the vehicle with the head lamps or rear lamps turned-on by operating a switch in order to secure a front visual field and to warn the rear driver.

As described above, a lamp for a vehicle is mounted on a front portion or a rear portion of the vehicle, and includes a light source installed in a housing on an inner side of the vehicle, a reflector reflecting light emitted from the light source, and a lens irradiating the light reflected by the reflector to an outside.

However, in the related art, since plural light sources are used to implement a lighting image, the manufacturing cost is increased. Further, since the lighting image is limited, the merchantability is degraded.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a double reflecting structure which can emit a predetermined quantity of light even with a small number of light sources.

In one aspect of the present invention, a double reflecting structure may include a first reflecting portion reflecting light that is emitted from a light source, and a second reflecting portion formed on one side of the first reflecting portion to reflect again the light that is reflected by the first reflecting portion.

The first reflecting portion is formed in a parabolic or peaked-hat shape.

The second reflecting portion is formed in a curved outer wall shape and is formed to project upward from the one side of the first reflecting portion.

The second reflecting portion is formed in a curved outer wall shape and is formed to protrude from the one side of the first reflecting portion and partially enclose the first reflecting portion.

A curvature center of the second reflecting portion is formed along a center axis of the first reflecting portion.

A plurality of refracting portions are formed on an inside of the second reflecting portion.

A plurality of first reflecting portions and a plurality of second reflecting portions are formed.

As described above, according to the present invention, the manufacturing cost is reduced due to the decrease of the number of light sources. Further, since the light emitted from the light source is reflected at various angles through a double reflecting portion to be irradiated to an outside, diverse lighting images are provided to improve the merchantability.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
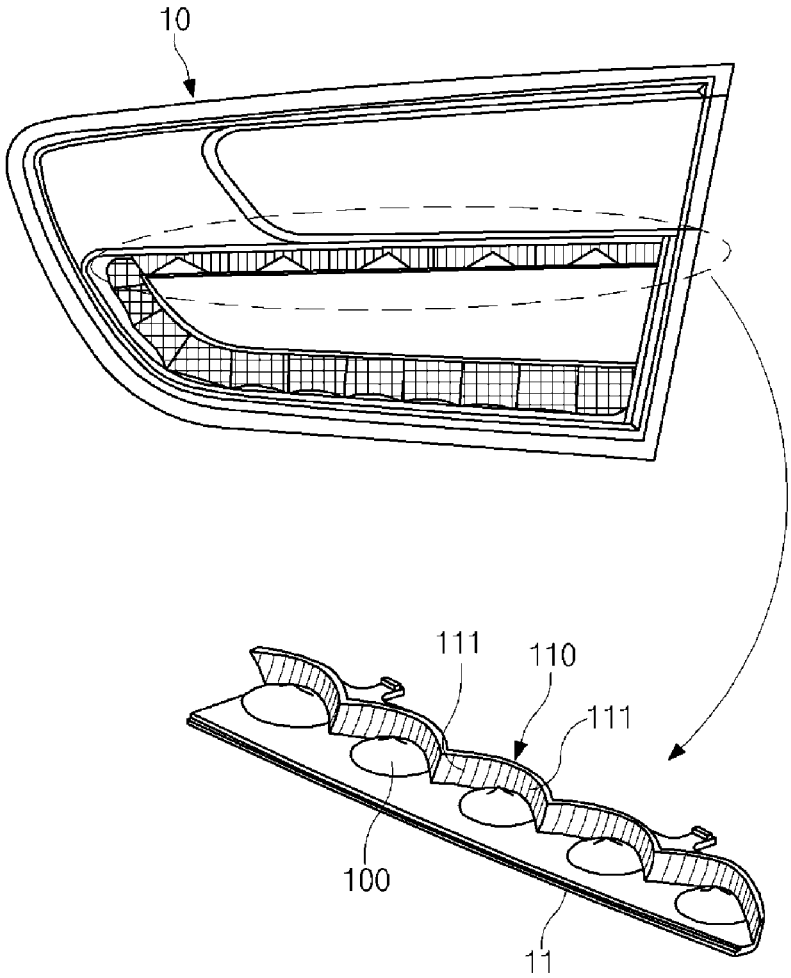
FIG. 1 is a view illustrating a double reflecting structure according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, a preferred embodiment of the present invention will be described with reference to the accompanying drawings.

Figure 2:
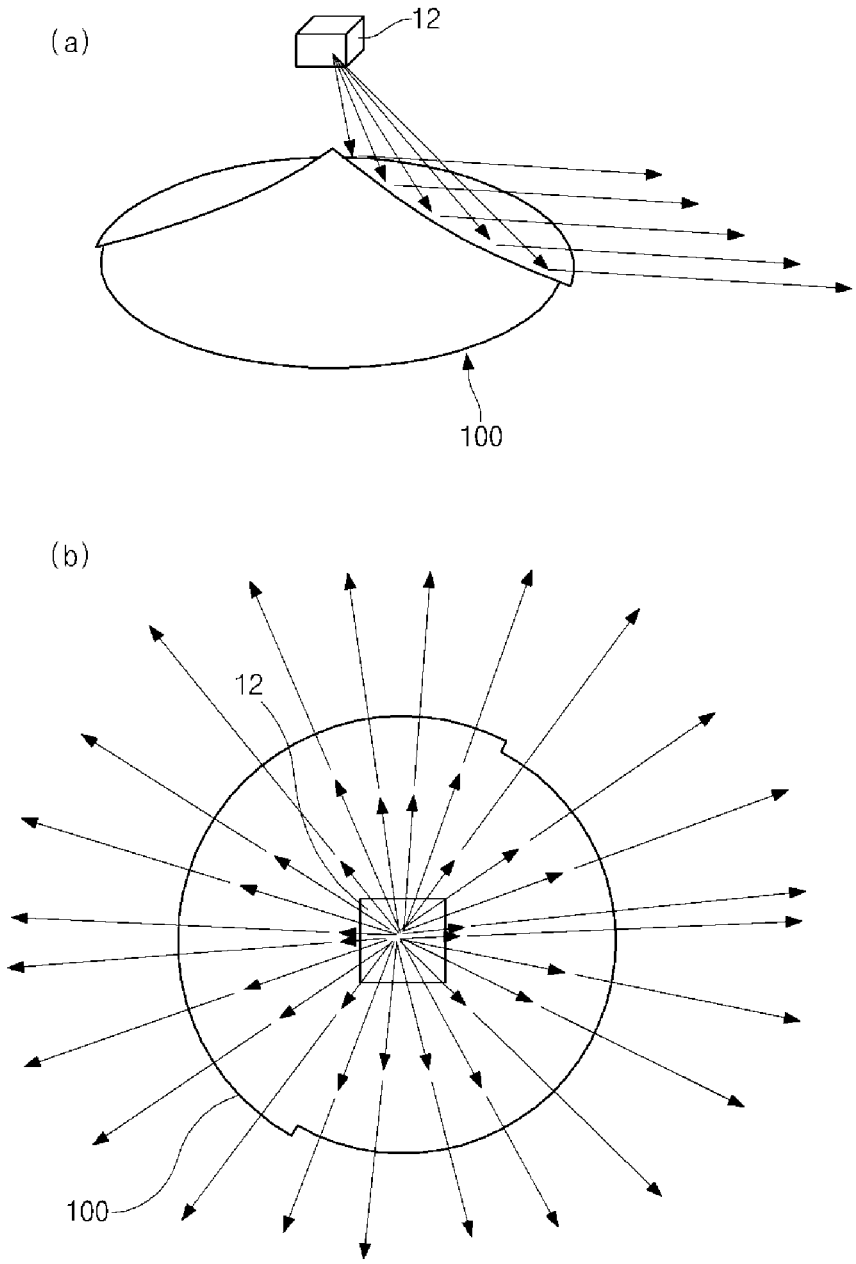
FIG. 2A is a view illustrating a first reflecting portion in a double reflecting structure according to an exemplary embodiment of the present invention.
FIG. 2B is a plan view illustrating a first reflecting portion in a double reflecting structure according to an exemplary embodiment of the present invention.
Figure 3:
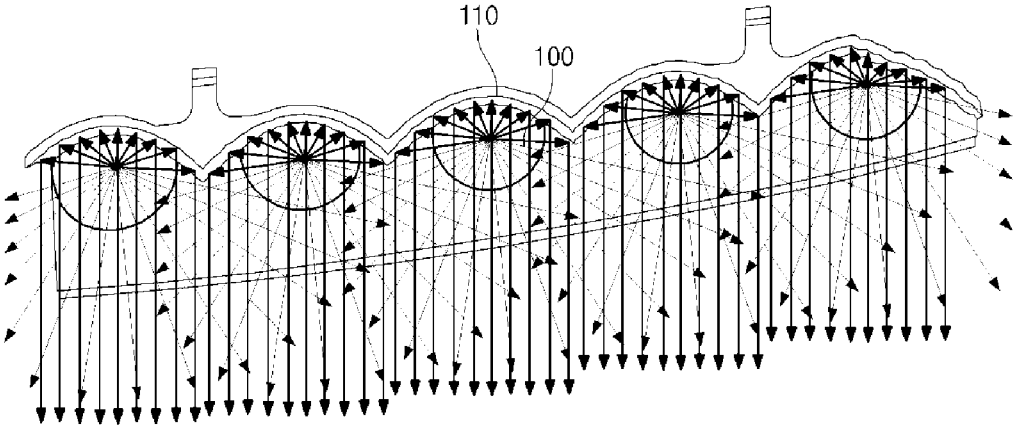
FIG. 3 is a plan view illustrating light that is reflected by a first reflecting portion and a second reflecting portion in a double reflecting structure according to an exemplary embodiment of the present invention.

FIGS. 1 to 3 illustrate a double reflecting structure according to an exemplary embodiment of the present invention. FIG. 1 is a view illustrating a double reflecting structure according to an exemplary embodiment of the present invention, FIGS. 2A and 2B are views illustrating a first reflecting portion in a double reflecting structure according to an exemplary embodiment of the present invention, and FIG. 3 is a plan view illustrating light that is reflected by a first reflecting portion and a second reflecting portion in a double reflecting structure according to an exemplary embodiment of the present invention.

As illustrated in FIGS. 1 to 3, a double reflecting structure according to an exemplary embodiment of the present invention includes a first reflecting portion 100 reflecting light that is emitted from a light source 12 at various angles, and a second reflecting portion 110 provided on one side of the first reflecting portion 100 to reflect again the light that is reflected by the first reflecting portion 100 at various angles. Since the light emitted from the light source 12 is reflected at various angles through a double reflecting portion to be irradiated to an outside, diverse lighting images can be implemented.

Hereinafter, constituent elements of the double reflecting structure according to an exemplary embodiment of the present invention will be described one by one with reference to the accompanying drawings.

First, as illustrated in FIG. 1, the double reflecting structure according to an exemplary embodiment of the present invention includes the first reflecting portion 100 that reflects the light, and the second reflecting portion 110 provided on one side of the first reflecting portion 100.

Here, the light source 12 (refer to FIG. 2) is provided inside a lamp 10 so as to irradiate the light to the first reflecting portion 100.

In this case, it is preferable that the light source 12 is provided with LEDs to maximize lighting images.

The first reflecting portion 100 is provided on an upper surface of a reflector panel 11 and reflects the light that is emitted from the light source 12 at various angles.

As illustrated in FIGS. 2A and 2B, the first reflecting portion 100 is formed in a parabolic or peaked-hat shape to reflect the light that is emitted from the light source 12 at various angles. In this case, the light is diffused and reflected in 360° directions by the parabolic or peaked-hat shape. However, as illustrated in FIG. 2A, it is preferable that the light is not reflected in the upward and downward directions so that an area related to high beam/low beam is not infringed.

As illustrated in FIG. 1, the second reflecting portion 110 is formed on one side of the first reflecting portion 100, and reflects again the light that is reflected by the first reflecting portion 100 at various angles. The second reflecting portion 110 is provided on the side surface of the reflector panel 11 having the first reflecting portion 100 provided on the upper surface thereof.

Here, as illustrated in FIG. 3, the second reflecting portion 110 is formed in a curved outer wall shape and is formed to project upward from the one side of the first reflecting portion 100. Accordingly, the light that is reflected by the first reflecting portion 100 is reflected to the second reflecting portion 110, and then is reflected at a predetermined angle without being dispersed.

On the other hand, it is preferable that a plurality of refracting portions 111 are formed on the inside of the second reflecting portion 110, and the light that is reflected by the first reflecting portion 100 is refracted and reflected by the refracting portions 111 of the second reflecting portion 110 to be irradiated to the outside.

In this case, it is preferable that a plurality of first reflecting portions 100 and a plurality of second reflecting portions 110 are formed.

Hereinafter, the effects of the present invention are as follows.

As illustrated in FIGS. 1, 2A and 2B, the double reflecting structure according to an exemplary embodiment of the present invention includes the first reflecting portion 100 reflecting light that is emitted from the light source 12 at various angles, and the second reflecting portion 110 provided on one side of the first reflecting portion 100 to reflect again the light that is reflected by the first reflecting portion 100 at various angles. Accordingly, the light emitted from the light source 12 is reflected at various angles through the double reflecting portion to be irradiated to the outside, and thus the lighting images can be improved.

In this case, the first reflecting portion 100 is formed in the parabolic or peaked-hat shape, and makes it possible to reflect the light that is emitted from the light source 12 at various angles. The second reflecting portion 110, which is formed on the one side of the first reflecting portion 100, reflects again the light that is reflected by the first reflecting portion at various angles, and as illustrated in FIG. 3, the light that is reflected by the first reflecting portion 100 is reflected to the second reflecting portion 110, and then is reflected at a predetermined angle without being dispersed. Further, the light is refracted and reflected by the plurality of refracting portions 111 formed inside the second reflecting portion 110 to be irradiated to the outside. Accordingly, the light is reflected at various angles and is irradiated to the outside even with a small number of light sources, and thus diverse lighting images can be implemented.

As described above, the double reflecting structure according to an exemplary embodiment of the present invention as constructed above includes the first reflecting portion reflecting light that is emitted from the light source, and the second reflecting portion formed on one side of the first reflecting portion to reflect again the light that is reflected by the first reflecting portion. Accordingly, the manufacturing cost is reduced due to the decrease of the number of light sources, and since the light emitted from the light source is reflected at various angles through a double reflecting portion to be irradiated to an outside, diverse lighting images are provided to improve the merchantability.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A double reflecting structure comprising:

a first reflecting portion reflecting light that is emitted from a light source; and a second reflecting portion formed on one side of the first reflecting portion to reflect again the light that is reflected by the first reflecting portion;

wherein the second reflecting portion is formed in a curved outer wall shape and is formed to protrude from the one side of the first reflecting portion and partially enclose the first reflecting portion.

2. The double reflecting structure according to claim 1, wherein the first reflecting portion is formed in a parabolic shape or a peaked-hat shape.

3. The double reflecting structure according to claim 1, wherein the second reflecting portion is formed in a curved outer wall shape and is formed to project upward from the one side of the first reflecting portion.

4. The double reflecting structure according to claim 1, wherein a plurality of first reflecting portions and a plurality of second reflecting portions are formed.

5. A double reflecting structure comprising:

a first reflecting portion reflecting light that is emitted from a light source; and a second reflecting portion formed on one side of the first reflecting portion to reflect again the light that is reflected by the first reflecting portion;

wherein a curvature center of the second reflecting portion is formed along a center axis of the first reflecting portion.

6. A double reflecting structure comprising:

a first reflecting portion reflecting light that is emitted from a light source; and a second reflecting portion formed on one side of the first reflecting portion to reflect again the light that is reflected by the first reflecting portion;

wherein a plurality of refracting portions are formed on an inside of the second reflecting portion.

* * * * *